US010668395B1

(12) United States Patent
Lee

(10) Patent No.: US 10,668,395 B1
(45) Date of Patent: Jun. 2, 2020

(54) MOTION SIMULATOR

(71) Applicant: MOTION DEVICE INC., Anyang-si (KR)

(72) Inventor: Jong Chan Lee, Anyang-si (KR)

(73) Assignee: MOTION DEVICE INC., Anyang-si (KR)

( * ) Notice: Subject to any disclaimer, the term of this patent is extended or adjusted under 35 U.S.C. 154(b) by 0 days.

(21) Appl. No.: 16/546,058

(22) Filed: Aug. 20, 2019

(30) Foreign Application Priority Data

Dec. 19, 2018 (KR) ..... 10-2018-0165512
Feb. 8, 2019 (KR) ..... 10-2019-0014728

(51) Int. Cl.
*A63G 31/16* (2006.01)
*A63G 31/02* (2006.01)
*G09B 9/02* (2006.01)

(52) U.S. Cl.
CPC ..... *A63G 31/16* (2013.01); *A63G 31/02* (2013.01)

(58) Field of Classification Search
CPC ..... A63G 31/00; A63G 31/02; A63G 31/04; A63G 31/08; G09B 9/00; G09B 9/02; G09B 9/10; G09B 9/12; G09B 9/14
USPC ..... 472/59–61, 130; 434/29, 55
See application file for complete search history.

(56) References Cited

U.S. PATENT DOCUMENTS 5,597,359 A * 1/1997 Byerly ..... A63G 31/16 434/55
5,752,834 A * 5/1998 Ling ..... G09B 9/12 434/55
6,152,828 A 11/2000 Tomita et al. ..... 472/60
6,445,960 B1 * 9/2002 Borta ..... G09B 9/02 434/30
2005/0277092 A1 * 12/2005 Hwang ..... G09B 19/16 434/55
2018/0369701 A1 * 12/2018 Yamada ..... A47C 7/002

* cited by examiner

*Primary Examiner* — Kien T Nguyen
(74) *Attorney, Agent, or Firm* — Stein IP, LLC

(57) ABSTRACT

A motion simulator capable of preventing shaking of a riding part is disclosed. The motion simulator includes a riding part and a plurality of driving parts, wherein the plurality of driving parts include a first driving part, a second driving part and a third driving part, and the first driving part includes a first linear actuator configured to linearly reciprocate a first moving body, first movable link members each having a lower end portion hinged to the first moving body, a first fixed link member hinged to the first movable link members, a first support link member supporting one side of the first fixed link member and hinged at the lower end portion of the first fixed link member, and a second support link member supporting the other side of the first fixed link member.

13 Claims, 13 Drawing Sheets

MOTION SIMULATOR

CROSS-REFERENCE TO RELATED APPLICATION

This application claims the benefit of Korean Application Nos. 10-2018-0165512, filed Dec. 19, 2018, and 10-2019-0014728, filed Feb. 8, 2019 in the Korean Intellectual Property Office. All disclosures of the documents named above are incorporated herein by reference.

BACKGROUND

1. Field of the Invention

The present disclosure relates to a motion simulator, and more particularly, to a motion simulator capable of stably supporting a riding part.

2. Discussion of Related Art

Generally, motion simulators are devices that allow a user to feel the movement in a virtual reality as if it is real by reproducing dynamic changes according to a virtual environment controlled by a computer, may implement flight simulations, driving simulations, and the like, and recently, are widely used for games, theater simulators, and the like to allow a user to experience three-dimensions.

Motion simulators perform a three-dimensional motion by combining linear motions and rotational motions. The motions of an object in space are made by combining the linear motions of a forward-backward direction (Z-axis), a left-right direction (X-axis), and an upward-downward direction (Y-axis) and the rotational motions of rolling around the Z-axis, pitching around the X-axis, and yawing around the Y-axis.

Among such motion simulators, a related art in which a lower part of a riding part is supported at three places is disclosed in U.S. Pat. No. 6,152,828.

In the related art, the lower part of the riding part is supported by three driving members. Upper end portions of the driving members are hinged to the riding part, and lower end portions of the driving members are hinged to a moving body.

The moving body is configured to perform a linear motion by a linear actuator. The linear actuator includes a motor, a shaft configured to perform a rotational motion by the motor, and a moving body configured to perform a linear motion by the rotational motion of the shaft. When the shaft rotates in place, the moving body performs a linear motion in a longitudinal direction of the shaft.

According to the conventional motion simulator having such a configuration, there is a problem that the riding part may be not stably supported, and shaking may occur.

Particularly, in the case of a motion simulator in which a plurality of passengers may ride on a riding part, there is a problem that the weight of the riding part and the passenger is great and thus shaking may occur during the operation of the motion simulator.

SUMMARY OF THE INVENTION

The present disclosure is directed to providing a motion simulator capable of preventing shaking of a riding part.

According to an aspect of the present disclosure, there is provided a motion simulator including a riding part (100) on which a passenger rides, and a plurality of driving parts configured to support a lower portion of the riding part (100), wherein the plurality of driving parts include a first driving part (200-1) configured to support a central portion of the riding part (100), and a second driving part (200-2) and a third driving part (200-3) positioned on both sides of the first driving part (200-1) with the first driving part (200-1) therebetween and configured to support one side and the other side of the lower portion of the riding part (100), respectively, and the first driving part (200-1) includes a first linear actuator configured to linearly reciprocate a first moving body (216-1), first movable link members (220-1 and 221-1) each having a lower end portion hinged to the first moving body (216-1) and an upper end portion hinged to a lower end portion of the riding part (100), a first fixed link member (230-1) having an upper end portion hinged to the first movable link members (220-1 and 221-1) and a lower end portion hinged at a position spaced apart from the first moving body (216-1), a first support link member (240-1) having an upper end portion supporting one side of the first fixed link member (230-1) and a lower end portion hinged at a position in a straight line with the lower end portion of the first fixed link member (230-1), and a second support link member (250-1) having an upper end portion supporting the other side of the first fixed link member (230-1) and a lower end portion hinged at a position in a straight line with the lower end portion of the first fixed link member (230-1) and the lower end portion of the first support link member (240-1).

The first movable link members (220-1 and 221-1) and the upper end portion of the first fixed link member (230-1) may be hinged to one link connection shaft (261), and the upper end portion of the first support link member (240-1) and the upper end portion of the second support link member (250-1) may be hinged to the link connection shaft (261).

The first movable link members (220-1 and 221-1) may be provided in a pair on both sides of the first fixed link member (230-1), the first support link member (240-1) may be hinged to one side of the first movable link member (220-1) positioned on one side thereof, and the second support link member (250-1) may be hinged to the other side of the first movable link member (221-1) positioned on the other side thereof.

A pair of ball joints (263*a* and 263*b*) may be coupled to both end portions of the link connection shaft (261) positioned outside the pair of first movable link members (220-1 and 221-1).

The upper end portion of the first support link member (240-1) may be hinged to one side of each of the first movable link members (220-1 and 221-1), and the upper end portion of the second support link member (250-1) may be hinged to the other side of each of the first movable link members (220-1 and 221-1).

A first link connection member (110-1) configured to connect the first driving part (200-1) thereto may be coupled to the lower portion of the riding part (100), both ends of a first supporting shaft (111-1) inserted thereinto may be coupled to both side surfaces of the first link connection member (110-1), and a first ball joint (112-1) may be coupled to the first supporting shaft (111-1) so that the first link connection member (110-1) and the riding part (100) are rotatable relative to each other.

The first ball joint (112-1) may be provided so as to be relatively movable within a range of a length of the first supporting shaft (111-1) in a state of being coupled to the first supporting shaft (111-1).

A first connection link member (222-1) provided in a horizontal direction may be integrally provided at the upper end portions of the first movable link members (220-1 and 221-1), and the first ball joint (112-1) may be coupled to an upper end portion of the first connection link member (222-1).

The lower end portion of the first support link member (240-1) maybe hinged to a first supporting member (241-1), which is fixed on a bottom supporting part (300), by a first supporting part hinge shaft (242-1), the lower end portion of the first support link member (240-1) may be integrally coupled to a first support link connection member (243-1) bent and extended in a direction toward the first supporting member (241-1) and may be hinged by the first supporting part hinge shaft (242-1) passing through and coupled to the first support link connection member (243-1), the first support link member (240-1) may be installed to be inclined at a predetermined angle in a direction of a link connection part (260), to which the first movable link member (220-1) and the first support link member (240-1) are hinged, with respect to the first support link connection member (243-1) based on an X-axis direction, the lower end portion of the second support link member (250-1) may be hinged to a second supporting member (251-1), which is fixed on the bottom supporting part (300), by a second supporting part hinge shaft (252-1), the lower end portion of the second support link member (250-1) may be integrally coupled to a second support link connection member (253-1) bent and extended in a direction toward the second supporting member (251-1) and may be hinged by the second supporting part hinge shaft (252-1) passing through and coupled to the second support link connection member (253-1), and the second support link member (250-1) may be installed to be inclined at a predetermined angle in the direction of the link connection part (260), to which the first movable link member (221-1) and the second support link member (250-1) are hinged, with respect to the second support link connection member (253-1) based on the X-axis direction.

The second driving part (200-2) may include a second linear actuator configured to linearly reciprocate a second moving body (216-2), second movable link members (220-2 and 221-2) each having a lower end portion hinged to the second moving body (216-2) and an upper end portion hinged to the lower end portion of the riding part (100), and a second fixed link member (230-2) having an upper end portion hinged to the second movable link members (220-2 and 221-2) and a lower end portion hinged at a position spaced apart from the second moving body (216-2), and the third driving part (200-3) may include a third linear actuator configured to linearly reciprocate a third moving body (216-3), third movable link members (220-3 and 221-3) each having a lower end portion hinged to the third moving body (216-3) and an upper end portion hinged to the lower end portion of the riding part (100), and a third fixed link member (230-3) having an upper end portion hinged to the third movable link members (220-3 and 221-3) and a lower end portion hinged at a position spaced apart from the third moving body (216-3).

The first linear actuator of the first driving part (200-1) may linearly reciprocate the first moving body (216-1) so that a first direction is a forward movement direction, the second linear actuator of the second driving part (200-2) may linearly reciprocate the second moving body (216-2) so that a second direction opposite to the first direction is a forward movement direction, and the third linear actuator of the third driving part (200-3) may linearly reciprocate the third moving body (216-3) so that the second direction is a forward movement direction.

The first driving part (200-1), the second driving part (200-2), and the third driving part (200-3) may support the lower portion of the riding part (100) at positions forming a triangle.

The lower portion of the riding part (100) may be coupled to: a first link connection member (110-1) configured to connect the first driving part (200-1) thereto, wherein both ends of a first supporting shaft (111-1) inserted thereinto are coupled to both side surfaces of the first link connection member (110-1), the first supporting shaft (111-1) is installed to have a length in an X-axis direction, a first ball joint (112-1) is coupled to the first supporting shaft (111-1) so that the first link connection member (110-1) and the riding part (100) are rotatable relative to each other, and the first ball joint (112-1) is provided so as to be relatively movable in the X-axis direction within a range of the length of the first supporting shaft (111-1) in a state of being coupled to the first supporting shaft (111-1); a second link connection member (110-2) configured to connect the second driving part (200-2) thereto, wherein both ends of a second supporting shaft (111-2) inserted thereinto are coupled to both side surfaces of the second link connection member (110-2), the second supporting shaft (111-2) is installed to have a length in a Z-axis direction orthogonal to the first supporting shaft (111-1), a second ball joint (112-2) is coupled to the second supporting shaft (111-2) so that the second link connection member (110-2) and the riding part (100) are rotatable relative to each other, and the second ball joint (112-2) is provided so as to be relatively movable in the Z-axis direction within a range of the length of the second supporting shaft (111-2) in the state of being coupled to the second supporting shaft (111-2); and a third link connection member (110-3) configured to connect the third driving part (200-3) thereto, wherein both ends of a third supporting shaft (111-3) inserted thereinto are coupled to both side surfaces of the third link connection member (110-3), the third supporting shaft (111-3) is installed to have a length in the Z-axis direction, a third ball joint (112-3) is coupled to the third supporting shaft (111-3) so that the third link connection member (110-3) and the riding part (100) are rotatable relative to each other, and the third ball joint (112-3) is provided so as to be relatively movable in the Z-axis direction within a range of the length of the third supporting shaft (111-3) in the state of being coupled to the third supporting shaft (111-3).

BRIEF DESCRIPTION OF THE DRAWINGS

The above and other objects, features, and advantages of the present disclosure will become more apparent to those of ordinary skill in the art by describing exemplary embodiments thereof in detail with reference to the accompanying drawings, in which.

DETAILED DESCRIPTION OF EXEMPLARY EMBODIMENTS

Hereinafter, the present disclosure will be described in detail with reference to the accompanying drawings.

Figure 1:
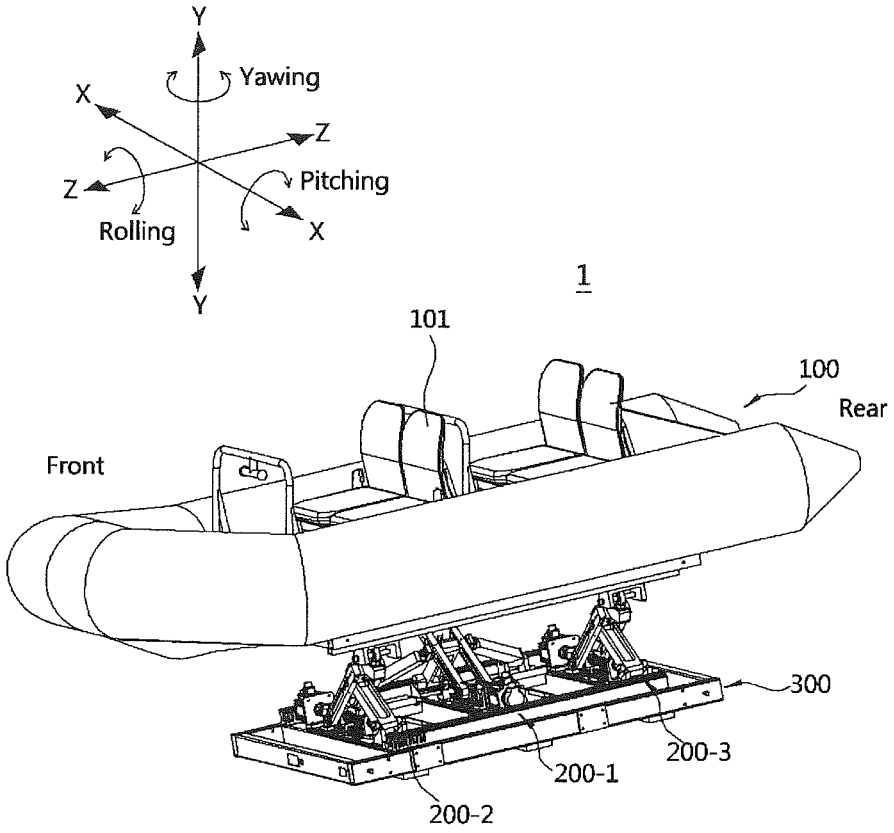
FIG. 1 is a perspective view illustrating a motion simulator according to the present disclosure.

When motions, rotation directions, and degrees of freedom are described with reference to FIG. 1, motions of an object in a space may include six motions such as a linear motion in a forward-backward direction (Z-axis), a linear motion in a left-right direction (X-axis), a linear motion in an upward-downward direction (Y-axis), rolling, which is a rotation around the Z-axis, pitching, which is a rotation around the X-axis, and yawing, which is a rotation around the Y-axis, which are called six degrees of freedom.

Hereinafter, as defined in FIG. 1, an axis connecting a right side and a left side is referred to as an "X-axis", an axis connecting an upper side and a lower side is referred to as a "Y-axis", and an axis connecting a front side and a rear side is referred to as a "Z-axis", which serve as references for describing the movement and the rotation direction, and when a user sits on a chair 101 on the Z-axis, a direction of a line of sight seen by the user is referred to as "forward", and a direction opposite to the forward direction is referred to as "backward".

Figure 2:
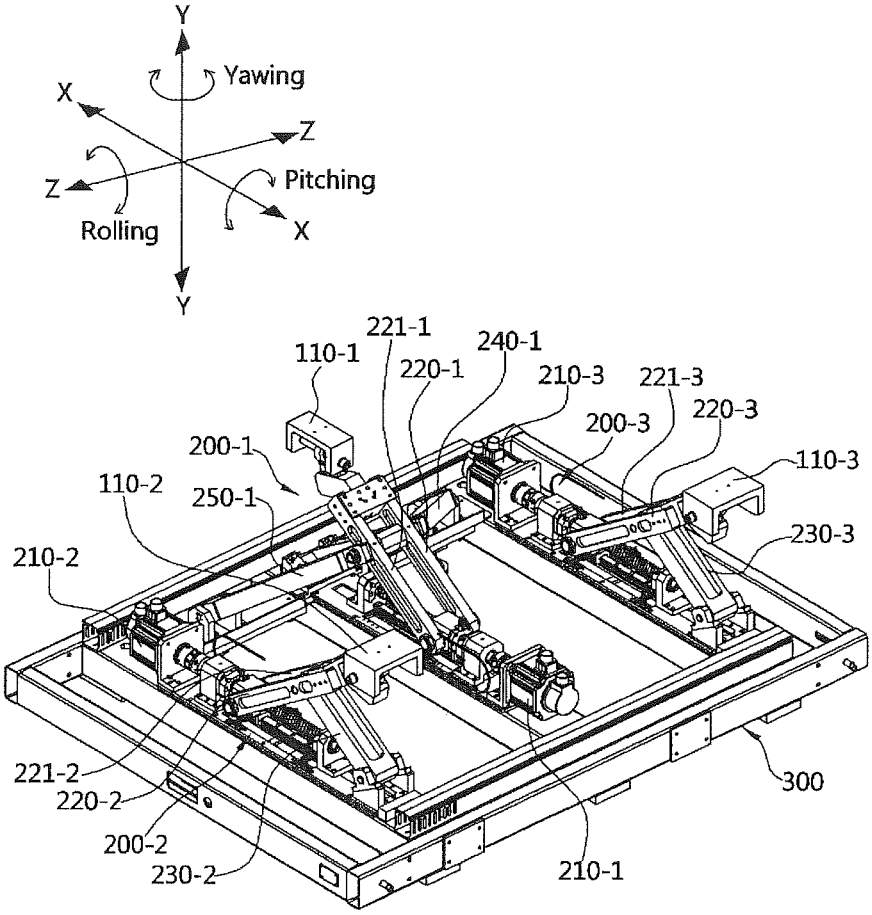
FIG. 2 is a perspective view illustrating a state in which a riding part is removed in the motion simulator of FIG. 1.
Figure 3:
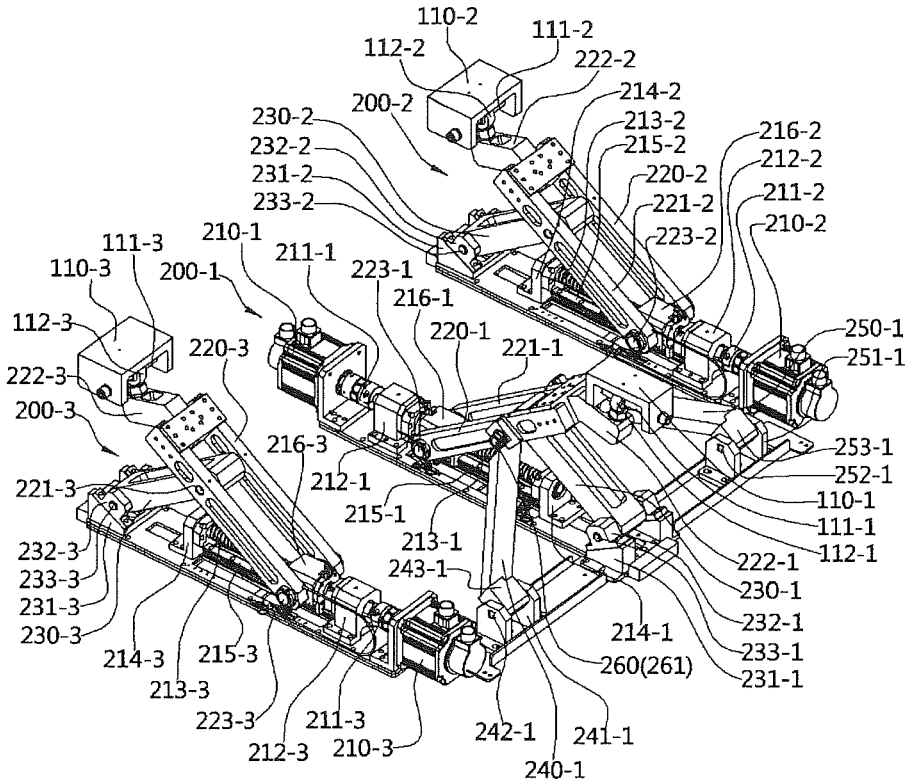
FIG. 3 is a perspective view illustrating a state in which a bottom supporting part is removed in the motion simulator of FIG. 2.
Figure 4:
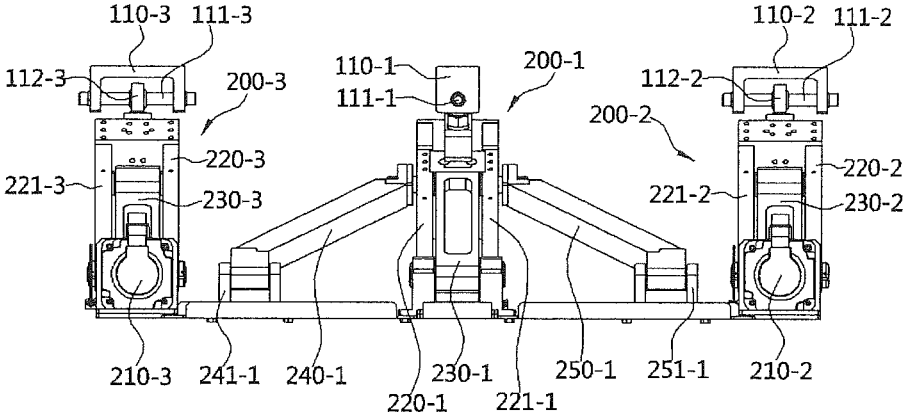
FIG. 4 is a side view of the motion simulator illustrated in FIG. 3.

A motion simulator 1 of the present disclosure will be described with reference to FIGS. 1 to 6. In FIG. 2 and FIG. 3, since the motion simulator 1 is in a state of being rotated 180 degrees, the position and the arrangement direction of each component are shown differently.

The motion simulator 1 of the present disclosure includes a riding part 100 on which a passenger rides, three driving parts 200-1, 200-2, and 200-3 configured to support a lower portion of the riding part 100, and a bottom supporting part 300 provided on a floor to support lower portions of the driving parts 200-1, 200-2, and 200-3.

The riding part 100 is provided with the chair 101 such that the passenger may sit thereon.

The three driving parts 200-1, 200-2, and 200-3 include a first driving part 200-1 supporting a central portion of the riding part 100 having a front-rear length in a Z-axis direction, and a second driving part 200-2 and a third driving part 200-3 respectively positioned at a front side and a rear side with the first driving part 200-1 therebetween and supporting one side and the other side of the lower portion of the riding part 100 with respect to the Z-axis direction, respectively.

The lower portion of the riding part 100 is coupled to the first link connection member 110-1 configured to connect the first driving part 200-1 thereto, the second link connection member 110-2 configured to connect the second driving part 200-2 thereto, and the third link connection member 110-3 configured to connect the third driving part 200-3 thereto.

When viewed in a plan view, the first link connection member 110-1 is coupled to one side edge of a bottom surface of the riding part 100 in an X-axis direction, and the second link connection member 110-2 and the third link connection member 110-3 are respectively coupled to a front side and a rear side in a Z-axis direction of the other side edge of the bottom surface of the riding part 100 in the X-axis direction. Accordingly, the first to third link connection members 110-1, 110-2, and 110-3 support the riding part 100 at three places, and the supporting positions are formed in a triangular shape.

The first link connection member 110-1 has a substantially inverted U-shaped cross section with respect to an XY plane and includes an upper surface to which the riding part 100 is coupled by a coupling member and both side surfaces to which both ends of a first supporting shaft 111-1 inserted thereinto are coupled.

The first supporting shaft 111-1 is installed to have a length in the X-axis direction. A first ball joint 112-1 is coupled to the first supporting shaft 111-1 so that the first link connection member 110-1 and the riding part 100 are rotatable relative to each other. The motion simulator 1 of the present disclosure implements the operation of the riding part 100 using rolling rotation and pitching rotation, but when fine rotation in a yawing direction occurs, the fine rotation may be absorbed by the first ball joint 112-1. Further, the first ball joint 112-1 is relatively movable in the X-axis direction within a range of the length of the first supporting shaft 111-1 in a state of being coupled to the first supporting shaft 111-1.

The first driving part 200-1 includes a first linear actuator that linearly reciprocates in the X-axis direction. The first linear actuator may include a first motor 210-1, a first connection part 211-1, a first fixing member 212-1, a first shaft 213-1, a first end supporting member 214-1, a first guide rail 215-1, and a first moving body 216-1.

The first motor 210-1 provides a rotational driving force for rotating the first shaft 213-1 by the application of electricity. The first connection part 211-1 configured to transmit power is provided between the first shaft 213-1 and the first motor 210-1.

The first shaft 213-1 is installed so as to have a length in the X-axis direction, and an outer peripheral surface of the first shaft 213-1 is processed in a spiral shape. The first shaft 213-1 includes one end portion supported by the first fixing member 212-1 and the other end portion supported by the first end supporting member 214-1. The first shaft 213-1 passes through the first fixing member 212-1, and the first shaft 213-1 is rotatable in a state in which the first shaft 213-1 passes through the first fixing member 212-1. The first end supporting member 214-1 supports the first shaft 213-1 so that the first shaft 213-1 is rotatable.

The first moving body 216-1 is formed with a through hole so that the first shaft 213-1 passes therethrough, and a spiral shape corresponding to the spiral shape formed on the outer peripheral surface of the first shaft 213-1 is formed on an inner peripheral surface of the through hole.

The first guide rail 215-1 is installed to have a length in the X-axis direction. The first moving body 216-1 is coupled to an upper portion of the first guide rail 215-1 so as to be movable in the X-axis direction. The first moving body 216-1 has a groove-shaped lower portion and is coupled to the first guide rail 215-1 with a structure in which a portion of the first guide rail 215-1 is inserted into the groove shape. Thus, when the first shaft 213-1 rotates in place, the first moving body 216-1 moves only in the X-axis direction and is prevented from rotating.

The first driving part 200-1 includes first movable link members 220-1 and 221-1, a first connection link member 222-1, a first movable link hinge shaft 223-1, a first fixed link member 230-1, first fixed link supporting parts 231-1 and 232-1, and a first fixed link hinge shaft 233-1 to connect the first linear actuator and the riding part 100 in a link structure.

The first movable link members 220-1 and 221-1 are formed as a pair provided on the front side and the rear side in the Z-axis direction and respectively connected to a front side surface and a rear side surface of the first moving body 216-1 in the Z-axis direction in a hinge structure by the first movable link hinge shaft 223-1, and thus capable of rolling rotation.

The first connection link member 222-1 provided in a horizontal direction is integrally provided on upper end portions of the first movable link members 220-1 and 221-1. The first connection link member 222-1 may be provided integrally with the pair of first movable link members 220-1 and 221-1 or may be provided integrally with one of the pair of first movable link members 220-1 and 221-1.

The first ball joint 112-1 is coupled to the upper end portion of the first connection link member 222-1.

The first fixed link member 230-1 is provided to be inclined to form an acute angle with the first movable link members 220-1 and 221-1 at an upper end portion thereof when viewed in the Z-axis direction. That is, the upper end portion of the first fixed link member 230-1 is hinged to the first movable link members 220-1 and 221-1 by a link connection part 260, and a lower end portion of the first fixed link member 230-1 is hinged to the first fixed link supporting parts 231-1 and 232-1 by the first fixed link hinge shaft 233-1.

The first fixed link supporting parts 231-1 and 232-1 are fixed and installed at positions spaced apart from the first shaft 213-1 in the X-axis direction and include a first lower fixed link supporting part 231-1 fixed to the bottom supporting part 300 and a first upper fixed link supporting part 232-1 coupled to an upper portion of the first lower fixed link supporting part 231-1. A surface of the first lower fixed link supporting part 231-1 in contact with the first upper fixed link supporting part 232-1 is inclined in a direction in which the first movable link members 220-1 and 221-1 are provided.

The lower end portion of the first fixed link member 230-1 is hinged to the first upper fixed link supporting part 232-1 by the first fixed link hinge shaft 233-1 so that rolling rotation of the first fixed link member 230-1 is performed.

The first driving part 200-1 further includes a first support link member 240-1 having an upper end portion supporting one side of the first fixed link member 230-1 and a lower end portion hinged at a position in a straight line L (refer to FIG. 7) with the lower end portion of the first fixed link member 230-1, and a second support link member 250-1 having an upper end portion supporting the other side of the first fixed link member 230-1 and a lower end portion hinged at a position in the straight line L with the lower end portion of the first fixed link member 230-1 and the lower end portion of the first support link member 240-1.

Figure 5:
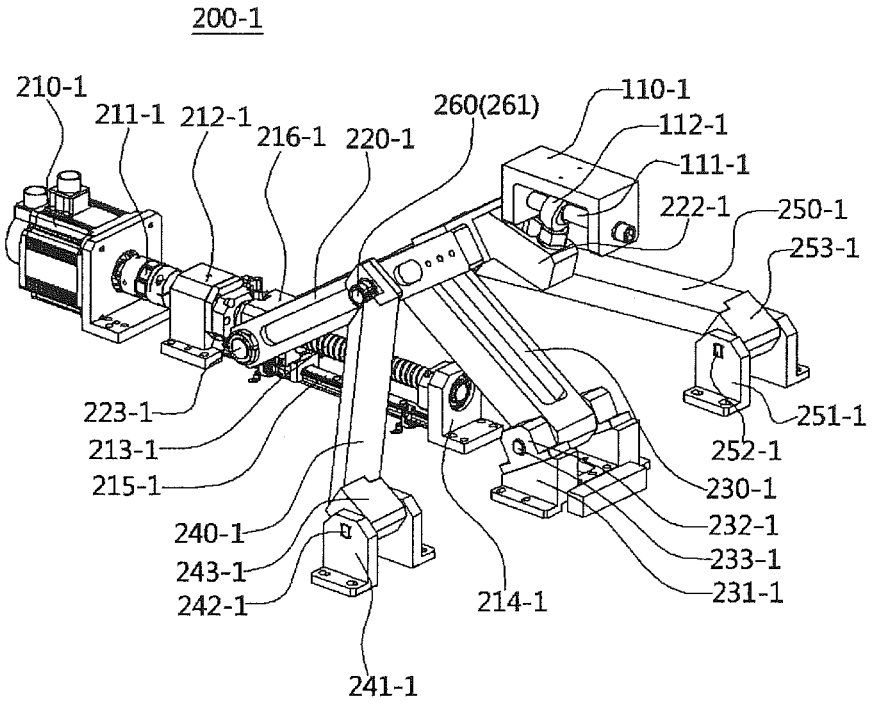
FIG. 5 is a perspective view illustrating a first driving part in the motion simulator according to the present disclosure.
Figure 6:
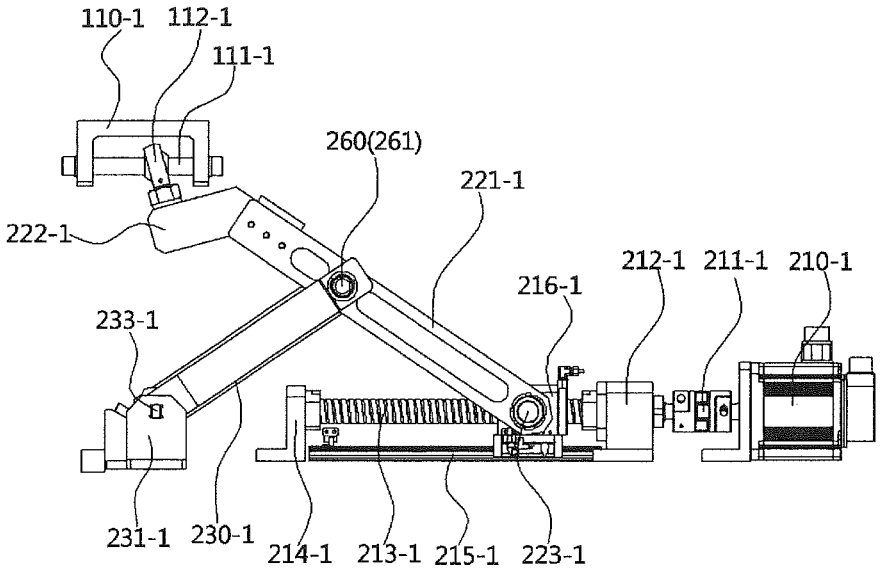
FIG. 6 is a side view of the first driving part of FIG. 5.
Figure 7:
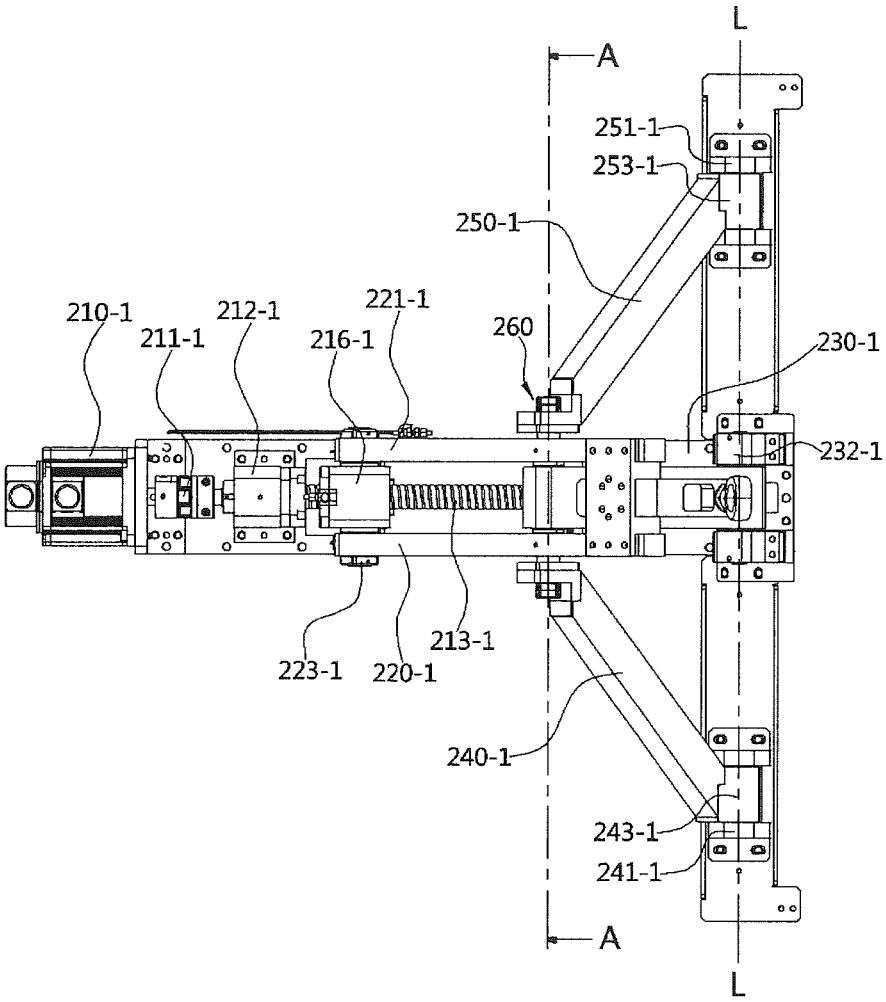
FIG. 7 is a plan view of the first driving part of FIG. 5.

Referring to FIGS. 5 and 7, in order to configure the lower end portion of the first fixed link member 230-1, the lower end portion of the first support link member 240-1, and the lower end portion of the second support link member 250-1 to be positioned on the straight line L, the first fixed link hinge shaft 233-1 provided at the lower end portion of the first fixed link member 230-1 and serving as a rotation center, a first supporting part hinge shaft 242-1 provided at the lower end portion of the first support link member 240-1 and serving as a rotation center, and a second supporting part hinge shaft 252-1 provided at the lower end portion of the second support link member 250-1 and serving as a rotation center are provided so as to be positioned on the straight line L.

By configuring the lower end portion of the first fixed link member 230-1, the lower end portion of the first support link member 240-1, and the lower end portion of the second support link member 250-1 to be hinged at positions in the straight line, the first fixed link member 230-1, the first support link member 240-1, and the second support link member 250-1 may smoothly rotate around the lower end portions thereof, respectively.

As one example, the first support link member 240-1 may be configured such that the upper end portion thereof is hinged to one side of each of the first movable link members 220-1 and 221-1, and the second support link member 250-1 may be configured such that the upper end portion thereof is hinged to the other side of each of the first movable link members 220-1 and 221-1.

As another example, the first support link member 240-1 may also be configured such that the upper end portion is connected to one side portion of the first fixed link member 230-1, and the second support link member 250-1 may be configured such that the upper end portion is connected to the other side portion of the first fixed link member 230-1. In this case, the upper end portion of the first support link member 240-1 may be integrally coupled or hinged to one side portion of the first fixed link member 230-1, and the upper end portion of the second support link member 250-1 may be integrally coupled or hinged the other side portion of the first fixed link member 230-1.

The first movable link members 220-1 and 221-1 and the first fixed link member 230-1 may be prevented from being shaken due to the first support link member 240-1 and the second support link member 250-1 so that the stability of the motion simulator 1 in operation may be improved.

The lower end portion of the first support link member 240-1 is hinged to a first supporting member 241-1, which is fixed on the bottom supporting part 300, by the first supporting part hinge shaft 242-1 so that rolling rotation of the first support link member 240-1 is enabled.

In this case, the lower end portion of the first support link member 240-1 may be integrally coupled to a first support link connection member 243-1 bent and extended in a direction toward the first supporting member 241-1 and may be hinged by the first supporting part hinge shaft 242-1 passing through and coupled to the first support link connection member 243-1. An upper end portion of the first support link connection member 243-1 is coupled to the lower end portion of the first support link member 240-1, and the first support link member 240-1 may be installed to be inclined at a predetermined angle in a direction of the link connection part 260 with respect to the first support link connection member 243-1 based on the X-axis direction.

The lower end portion of the second support link member 250-1 is hinged to a second supporting member 251-1, which is fixed on the bottom supporting part 300, by the second supporting part hinge shaft 252-1 so that rolling rotation of the second support link member 250-1 is enabled.

In this case, the lower end portion of the second support link member 250-1 may be integrally coupled to a second support link connection member 253-1 bent and extended in a direction toward the second supporting member 251-1 and may be hinged by the second supporting part hinge shaft 252-1 passing through and coupled to the second support link connection member 253-1. An upper end portion of the second support link connection member 253-1 is coupled to the lower end portion of the second support link member 250-1, and the second support link member 250-1 may be installed to be inclined at a predetermined angle in the direction of the link connection part 260 with respect to the second support link connection member 253-1 based on the X-axis direction.

With such a configuration, a first supporting part including the first support link member 240-1, the first supporting member 241-1, first supporting part hinge shaft 242-1, and the first support link connection member 243-1, and a second supporting part including the second support link member 250-1, the second supporting member 251-1, the second supporting part hinge shaft 252-1, and the second support link connection member 253-1 may be symmetrically disposed on the front side and the rear side with respect to the X-axis connecting the first fixed link member 230-1 and the link connection part 260.

Further, by configuring the first support link connection member 243-1 to be bent and extended in the direction toward the first supporting member 241-1 at the lower end portion of the first support link member 240-1 and configuring the second support link connection member 253-1 to be bent and extended in the direction toward the second supporting member 251-1 at the lower end portion of the second support link member 250-1, the first supporting member 241-1 and the second supporting member 251-1 may be installed in a direction parallel to a frame constituting the bottom supporting part 300 so that the structure in which the first supporting member 241-1 and the second supporting member 251-1 are installed on the bottom supporting part 300 may be simplified.

The second link connection member 110-2 has the same shape as the first link connection member 110-1 and is provided with a second supporting shaft 111-2 corresponding to the first supporting shaft 111-1 and a second ball joint 112-2 identical to the first ball joint 112-1. In this case, the second supporting shaft 111-2 has a length in the Z-axis direction orthogonal to the first supporting shaft 111-1. The second ball joint 112-2 is relatively movable within a range of the length of the second supporting shaft 111-2 in a state of being coupled to the second supporting shaft 111-2. Here, the same configuration includes not only the case in which dimensions are completely the same but also the case in which shapes, functions, operating directions, and the like are the same even though some of the dimensions are different, and the same may be used in the following description.

The second driving part 200-2 includes a second linear actuator that linearly reciprocates in the X-axis direction. The second linear actuator has the same configuration as that of the first linear actuator. That is, the second linear actuator may include a second motor 210-2 identical to the first motor 210-1, a second connection part 211-2 identical to the first connection part 211-1, a second fixing member 212-2 identical to the first fixing member 212-1, a second shaft 213-2 identical to the first shaft 213-1, a second end supporting member 214-2 identical to the first end supporting member 214-1, a second guide rail 215-2 identical to the first guide rail 215-1, and a second moving body 216-2 identical to the first moving body 216-1.

Further, the second driving part 200-2 includes second movable link members 220-2 and 221-2 identical to the first movable link members 220-1 and 221-1, a second connection link member 222-2 identical to the first connection link member 222-1, a second movable link hinge shaft 223-2 identical to the first movable link hinge shaft 223-1, a second fixed link member 230-2 identical to the first fixed link member 230-1, second fixed link supporting parts 231-2 and 232-2 identical to the first fixed link supporting parts 231-1 and 232-1, and a second fixed link hinge shaft 233-2 identical to the first fixed link hinge shaft 233-1 to connect the second linear actuator and the riding part 100 in a link structure.

However, the first driving part 200-1 and the second driving part 200-2 are different in that the second motor 210-2 is positioned on the opposite side of the first motor 210-1 with respect to the Z-axis passing through the center of the motion simulator, and the remaining parts of the second driving part 200-2 are also positioned in the opposite direction to the first driving part 200-1 by being rotated 180 degrees with respect to the Y-axis.

The third driving part 200-3 and the second driving part 200-2 are entirely the same in configuration and are located on the front side and the rear side in the Z-axis direction with the first driving part 200-1 therebetween. That is, the third driving part 200-2 includes a third linear actuator that linearly reciprocates in the X-axis direction. All the configurations of the third linear actuator are identical to those of the second linear actuator, including installed positions and operating directions. That is, the third linear actuator may include a third motor 210-3 identical to the second motor 210-2, a third connection part 211-3 identical to the second connection part 211-2, a third fixing member 212-3 identical to the second fixing member 212-2, a third shaft 213-3 identical to the second shaft 213-2, a third end supporting member 214-3 identical to the second end supporting member 214-2, a third guide rail 215-3 identical to the second guide rail 215-2, and a third moving body 216-3 identical to the second moving body 216-2.

Further, the third driving part 200-3 includes third movable link members 220-3 and 221-3 identical to the second movable link members 220-2 and 221-2, a third connection link member 222-3 identical to the second connection link member 222-2, a third movable link hinge shaft 223-3 identical to the second movable link hinge shaft 223-2, a third fixed link member 230-3 identical to the second fixed link member 230-2, third fixed link supporting parts 231-3 and 232-3 identical to the second fixed link supporting parts 231-2 and 232-2, and a third fixed link hinge shaft 233-3 identical to the second fixed link hinge shaft 233-2 to connect the third linear actuator and the riding part 100 in a link structure.

However, the first driving part 200-1 and the third driving part 200-3 are different in that the third motor 210-3 is positioned on the opposite side of the first motor 210-1 with respect to the Z-axis passing through the center of the motion simulator, and the remaining parts of the third driving part 200-3 are also positioned in the opposite direction to the first driving part 200-1 by being rotated 180 degrees with respect to the Y-axis.

Figure 8:
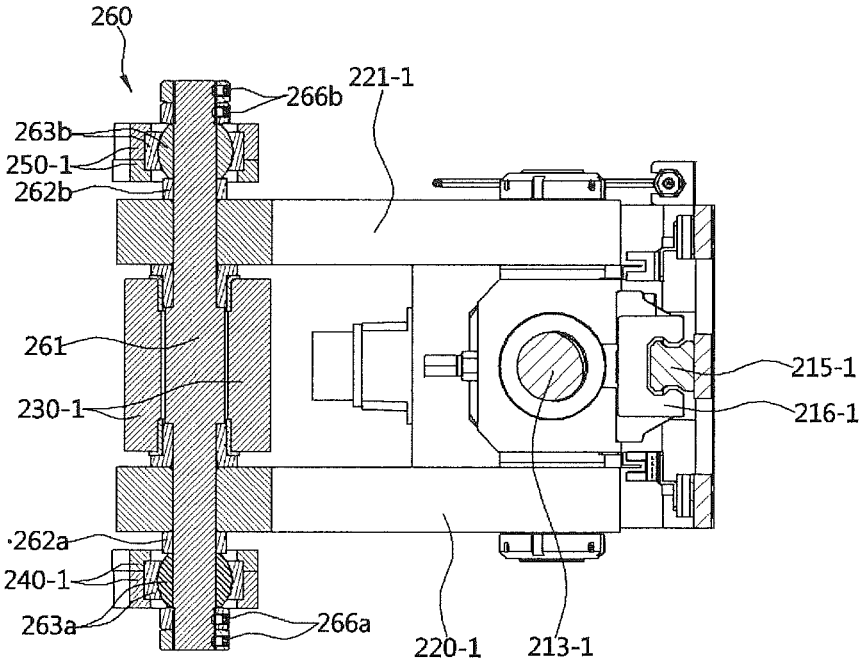
FIG. 8 is a cross-sectional view taken along line A-A of FIG. 7.

The link connection part 260 will be described with reference to FIGS. 7 and 8.

The link connection part 260 includes a link connection shaft 261 having a rod shape and a length in the Z-axis direction so as to pass through the pair of first movable link members 220-1 and 221-1 in the Z-axis direction.

A portion of the link connection shaft 261 positioned between the pair of first movable link members 220-1 and 221-1 is provided to pass through an upper end portion of the first fixed link member 230-1. Thus, rolling rotation may be enabled.

A ball joint 263*a* is coupled to one end portion of the link connection shaft 261 positioned outside the pair of first movable link members 220-1 and 221-1, and the first support link member 240-1 is coupled to an outside of the ball joint 263*a*. Thus, the first support link member 240-1 and the link connection shaft 261 may relatively rotate by the ball joint 263*a*.

A pair of lock nuts 266*a* are coupled to the one end portion of the link connection shaft 261 so that the first support link member 240-1 and the ball joint 263*a* are prevented from being separated from the link connection shaft 261. A space ring 262*a* is coupled to the link connection shaft 261 to maintain a spaced state between the first movable link member 220-1 and the ball joint 263*a*.

A ball joint 263*b* is also coupled to the other end portion of the link connection shaft 261 positioned outside the pair of first movable link members 220-1 and 221-1, and the second support link member 250-1 is coupled to an outside of the ball joint 263*b*. Thus, the second support link member 250-1 and the link connection shaft 261 may rotate relative to each other by the ball joint 263*b*.

A pair of lock nuts 266*b* are coupled to the other end portion of the link connection shaft 261 so that the second support link member 250-1 and the ball joint 263*b* are prevented from being separated from the link connection shaft 261. A space ring 262*b* is coupled to the link connection shaft 261 to maintain a spaced state between the first movable link member 221-1 and the ball joint 263*b*.

As described above, by connecting both end portions of the link connection shaft 261 to the first support link member 240-1 and the second support link member 250-1 through the ball joints 263*a* and 263*b*, errors may be absorbed even when the dimensions at the time of assembly do not match exactly so that the assemblability may be improved.

When the link connection shaft 261 is divided into two and the upper end portion of each of the first support link member 240-1 and the second support link member 250-1 is connected to each of the two link connection shafts, the two link connection shafts may not be aligned. Accordingly, in the present disclosure, the upper end portions of the first support link member 240-1 and the second support link member 250-1 are fixed to both end portions of one link connection shaft 261 by the ball joints 263*a* and 263*b* so that the link connection shaft 261 is prevented from being twisted.

Further, according to the present disclosure, the lower portion of the riding part 100 is supported at three places, and the first movable link members 220-1 and 221-1 supporting the middle of the riding part 100 and the first support link member 240-1 and the second support link member 250-1 capable of preventing the first fixed link member 230-1 from shaking are provided so that the stability of the motion simulator in operation may be improved.

Hereinafter, an example of an operation state of the motion simulator according to the present disclosure will be described with reference to FIGS. 9A to 14B.

Figure 9A:
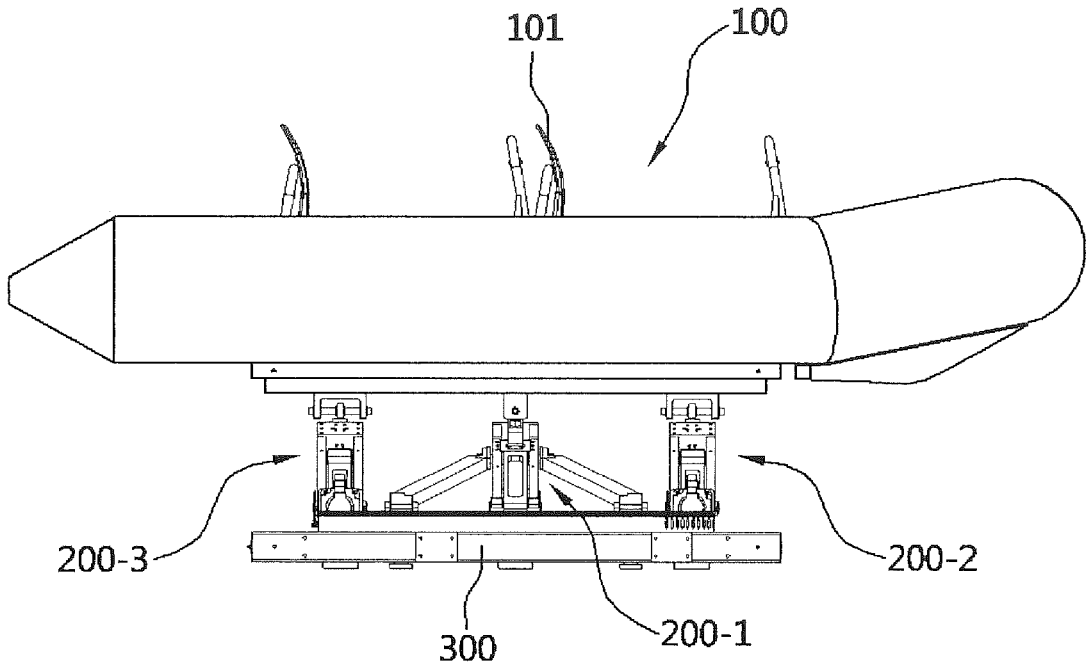
FIGS. 9A and 9B are operational state views illustrating initial states of first to third driving parts in the motion simulator according to the present disclosure.
Figure 9B:
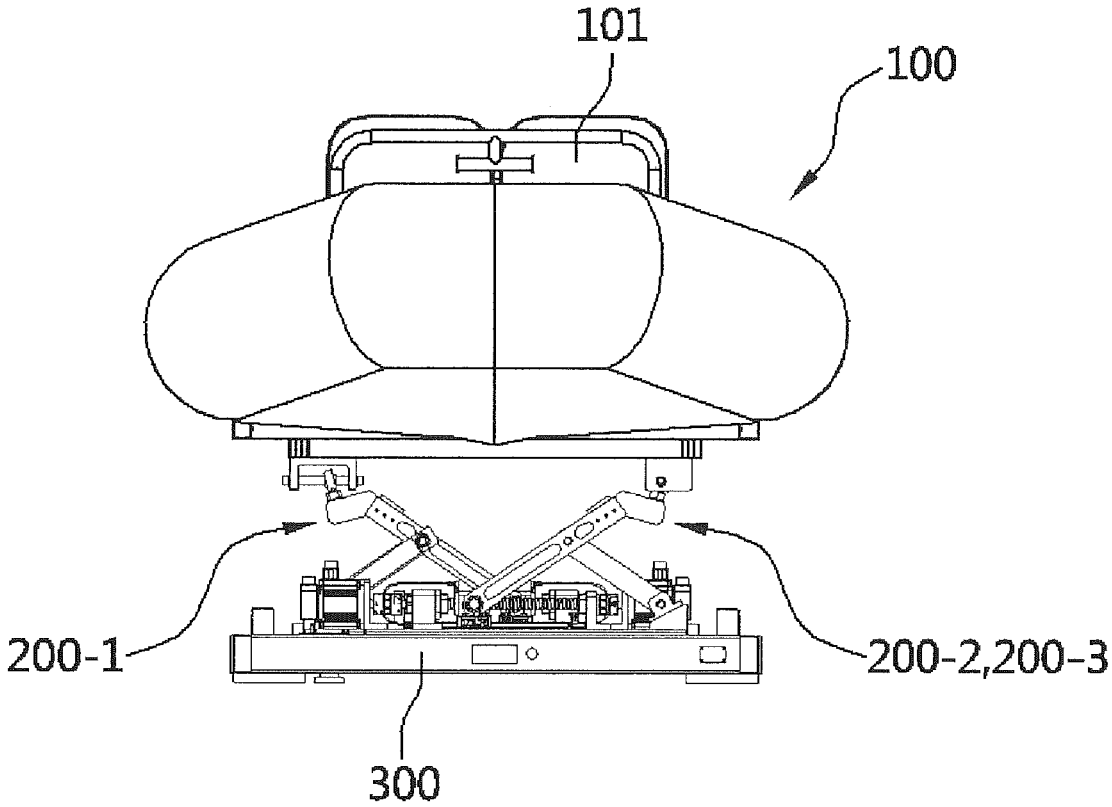

FIGS. 9A and 9B are operational state views illustrating initial states of the first driving part 200-1, the second driving part 200-2, and the third driving part 200-3 in the motion simulator according to the present disclosure.

Here, the first driving part 200-1 causes the first moving body 216-1 to move backward in a second direction so that an angle between the first movable link members 220-1 and 221-1 and the first fixed link member 230-1 is maximized, and the first link connection member 110-1 moves to the lowermost side. At the same time, the second driving part 200-2 and the third driving part 200-3 cause each of the second moving body 216-2 and the third moving body 216-3 to move backward in a first direction so that an angle between the second movable link members 220-2 and 221-2 and the second fixed link member 230-2 and an angle between the third movable link members 220-3 and 221-3 and the third fixed link member 230-3 are maximized, and the second link connection member 110-2 and the third link connection member 110-3 move to the lowermost sides. In this case, the first link connection member 110-1, the second link connection member 110-2, and the third link connection member 110-3 are positioned at the same height so that the riding part 100 is lowered and positioned in a horizontal state.

Figure 10A:
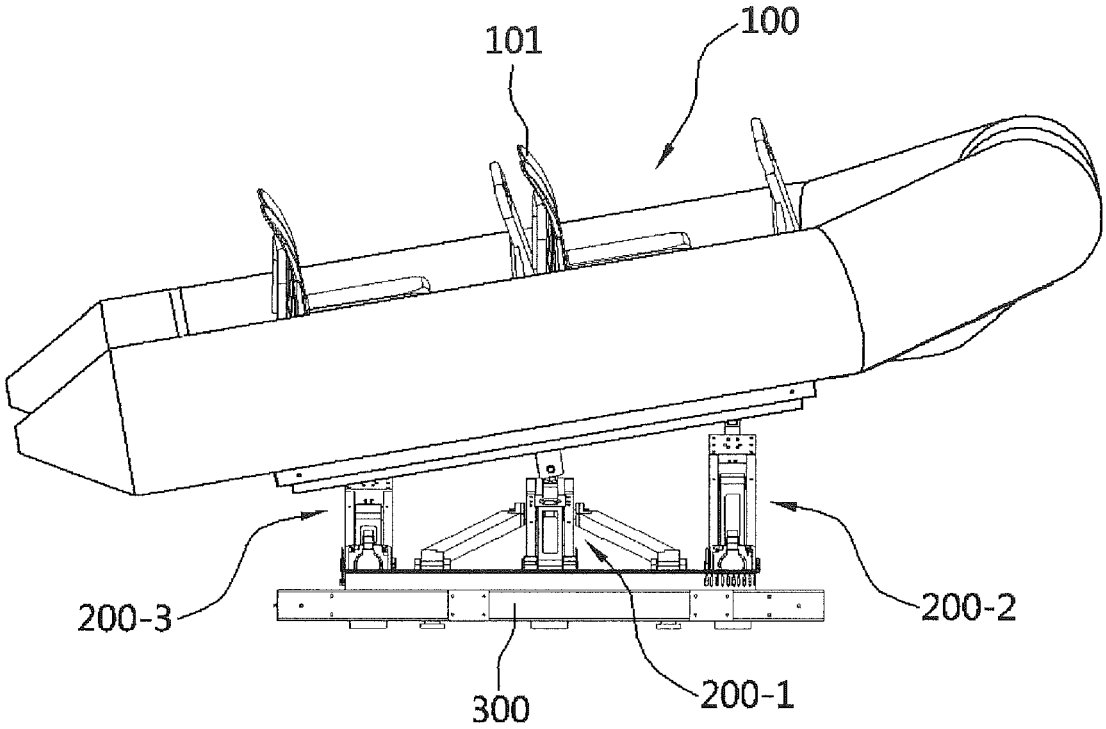
FIGS. 10A and 10B are views illustrating a state in which a second driving part is extended in the motion simulator according to the present disclosure.
Figure 10B:
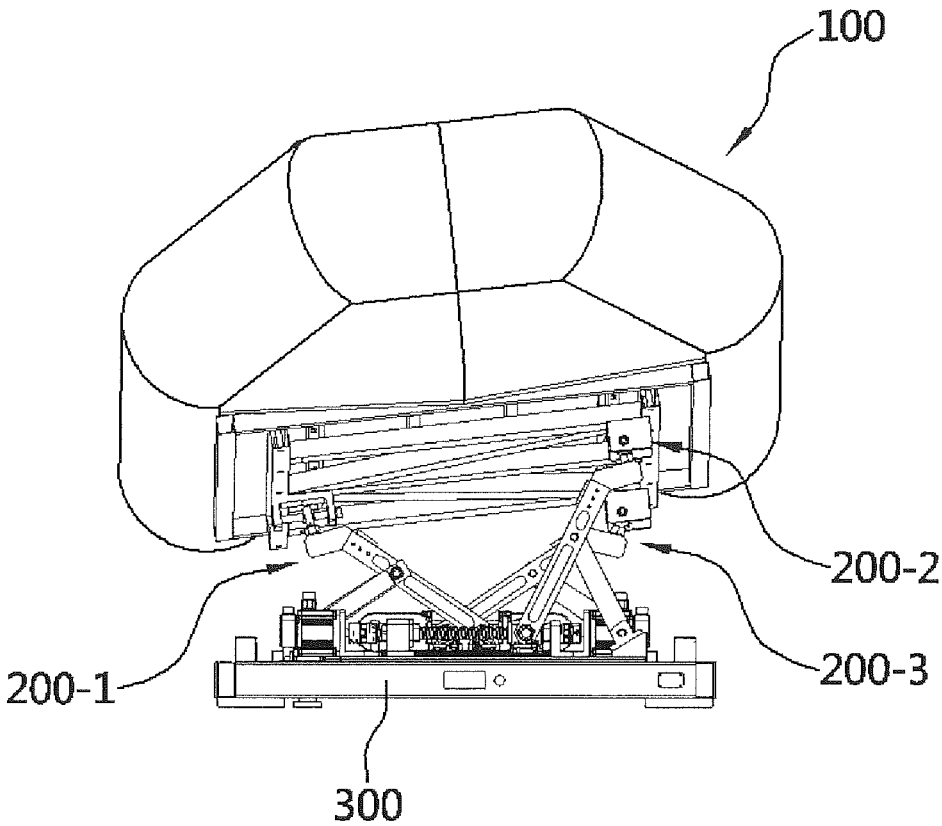

FIGS. 10 and 10B are views illustrating a state in which the second driving part is extended in the motion simulator according to the present disclosure.

In this case, the first driving part 200-1 and the third driving part 200-3 are in the initial states as shown in FIG. 9, and the second driving part 200-2 causes the second moving body 216-2 to move forward in the second direction so that the angle between the second movable link members 220-2 and 221-2 and the second fixed link member 230-2 is minimized, and the second link connection member 110-2 is moved to the uppermost side. As described above, when only the second driving part 200-2 is driven in the state of being extended, the rolling rotation in which a left side is inclined upward is performed, and the pitching rotation in which the front side is inclined upward is performed based on the direction of the passenger.

Figure 11A:
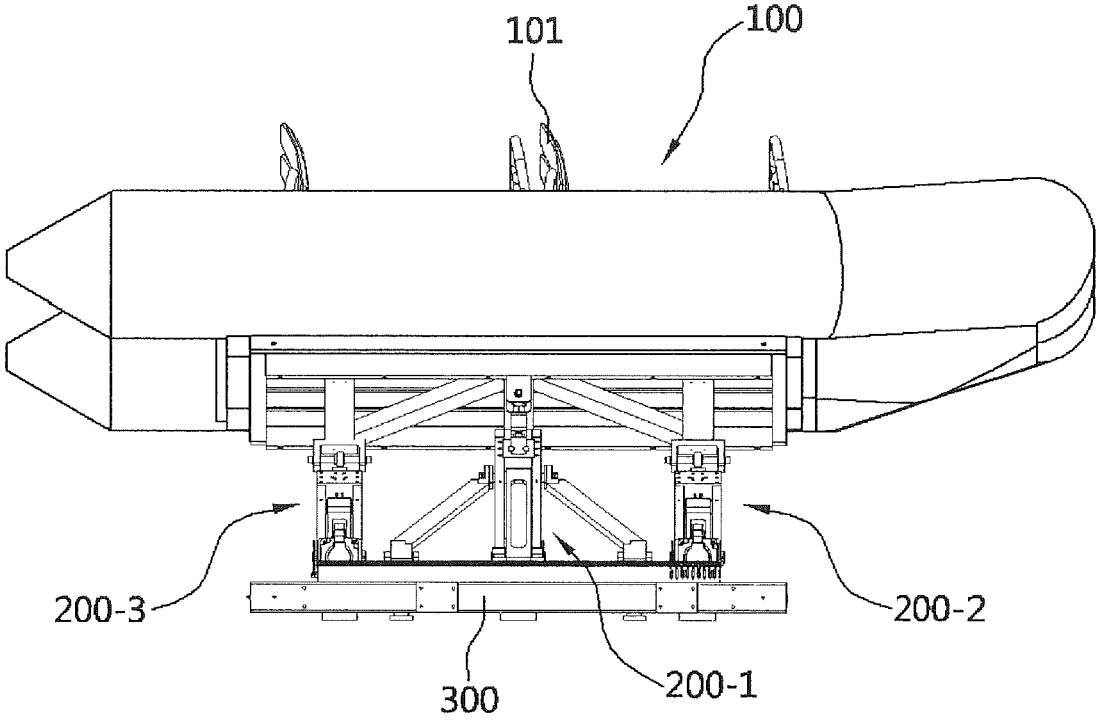
FIGS. 11A and 11B are views illustrating a state in which the first driving part is extended in the motion simulator according to the present disclosure.
Figure 11B:
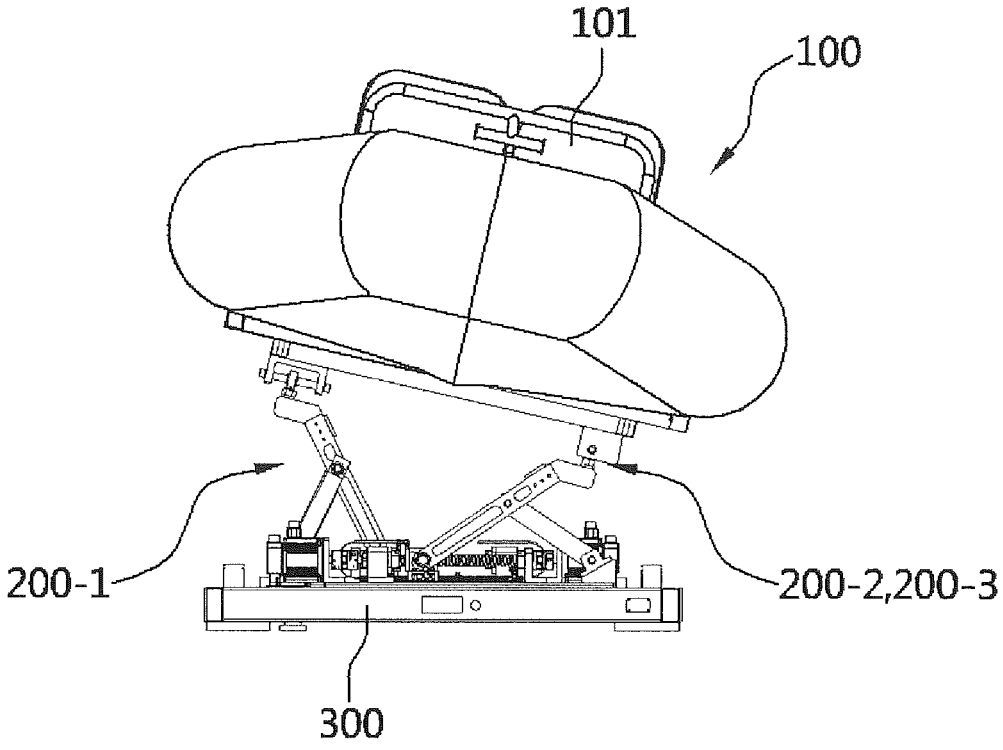

FIGS. 11A and 11B are views illustrating a state in which the first driving part is extended in the motion simulator according to the present disclosure.

In this case, the second driving part 200-2 and the third driving part 200-3 are in the initial states as shown in FIGS. 9A and 9B, and the first driving part 200-1 causes the first moving body 216-1 to move forward in the first direction so that the angle between the first movable link members 220-1 and 221-1 and the first fixed link member 230-1 is minimized, and the first link connection member 110-1 is moved to the uppermost side. As described above, when only the first driving part 200-1 is driven in the state of being extended, the rolling rotation in which a right side is inclined upward is performed based on the direction of the passenger.

Figure 12A:
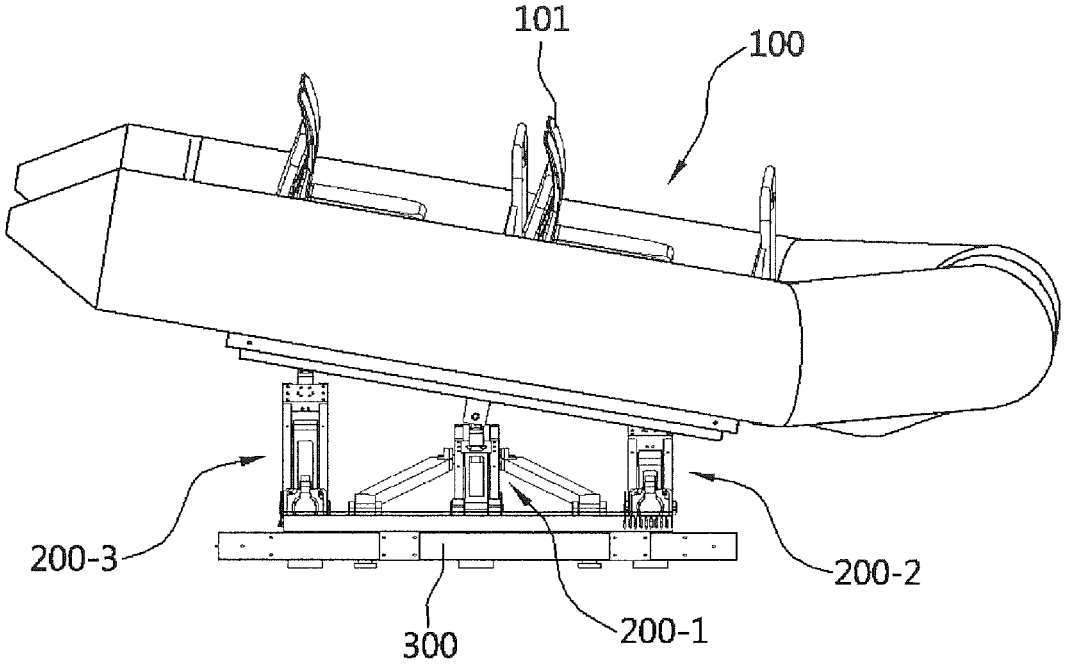
FIGS. 12A and 12B are views illustrating a state in which a third driving part is extended in the motion simulator according to the present disclosure.
Figure 12B:
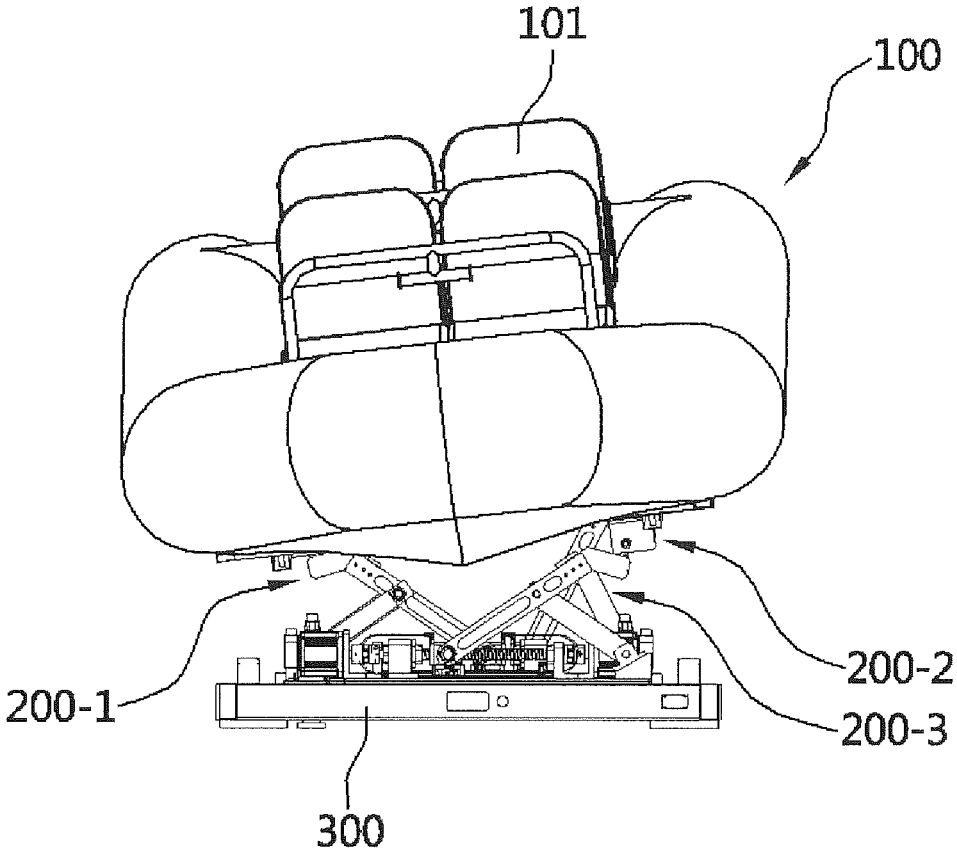

FIGS. 12A and 12B are views illustrating a state in which the third driving part is extended in the motion simulator according to the present disclosure.

In this case, the first driving part 200-1 and the second driving part 200-2 are in the initial states as shown in FIGS. 9A and 9B, and the third driving part 200-3 causes the third moving body 216-3 to move forward in the second direction so that the angle between the third movable link members 220-3 and 221-3 and the third fixed link member 230-3 is minimized, and the third link connection member 110-3 is moved to the uppermost side. As described above, when only the third driving part 200-3 is driven in the state of being extended, the rolling rotation in which the left side is inclined upward is performed, and the pitching rotation in which the front side is inclined downward is performed based on the direction of the passenger.

Figure 13A:
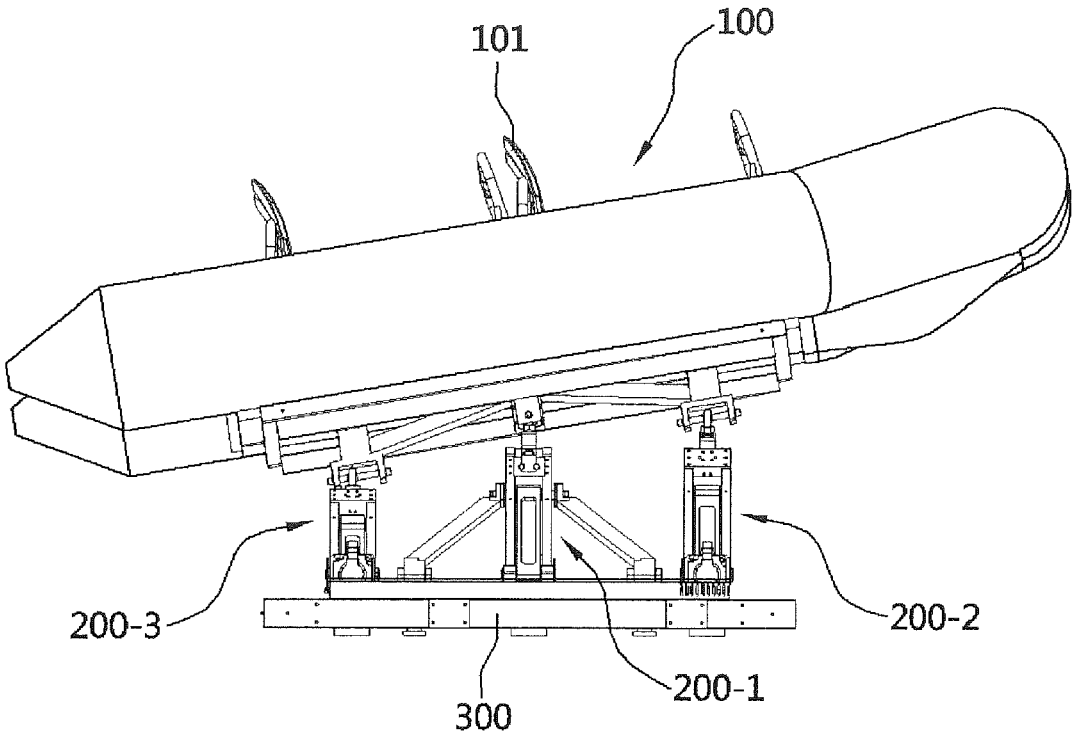
FIGS. 13A and 13B are views illustrating a state in which the first driving part and the second driving part are extended in the motion simulator according to the present disclosure.
Figure 13B:
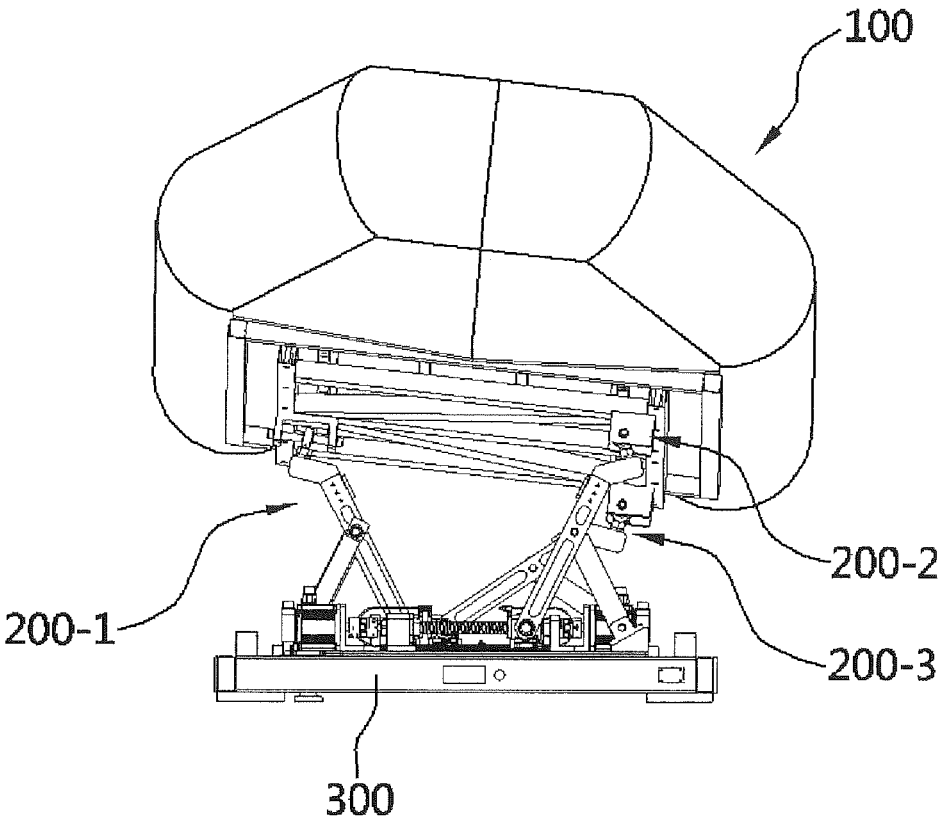

FIGS. 13A and 13B are views illustrating a state in which the first driving part and the second driving part are extended in the motion simulator according to the present disclosure.

In this case, the third driving part 200-3 is in the initial state as shown in FIGS. 9A and 9B, and the first driving part 200-1 causes the first moving body 216-1 to move forward in the first direction so that the angle between the first movable link members 220-1 and 221-1 and the first fixed link member 230-1 is minimized, and the first link connection member 110-1 is moved to the uppermost side, and at the same time, the second driving part 200-2 causes the second moving body 216-2 to move forward in the second direction so that the angle between the second movable link members 220-2 and 221-2 and the second fixed link member 230-2 is minimized, and the second link connection member 110-2 is moved to the uppermost side. As described above, when the first driving part 200-1 and the second driving part 200-2 are driven to be in the state of being extended at the same time, the operations of FIGS. 10A-11B are performed together, and the rolling, pitching, and yawing rotations are performed in combination.

Figure 14A:
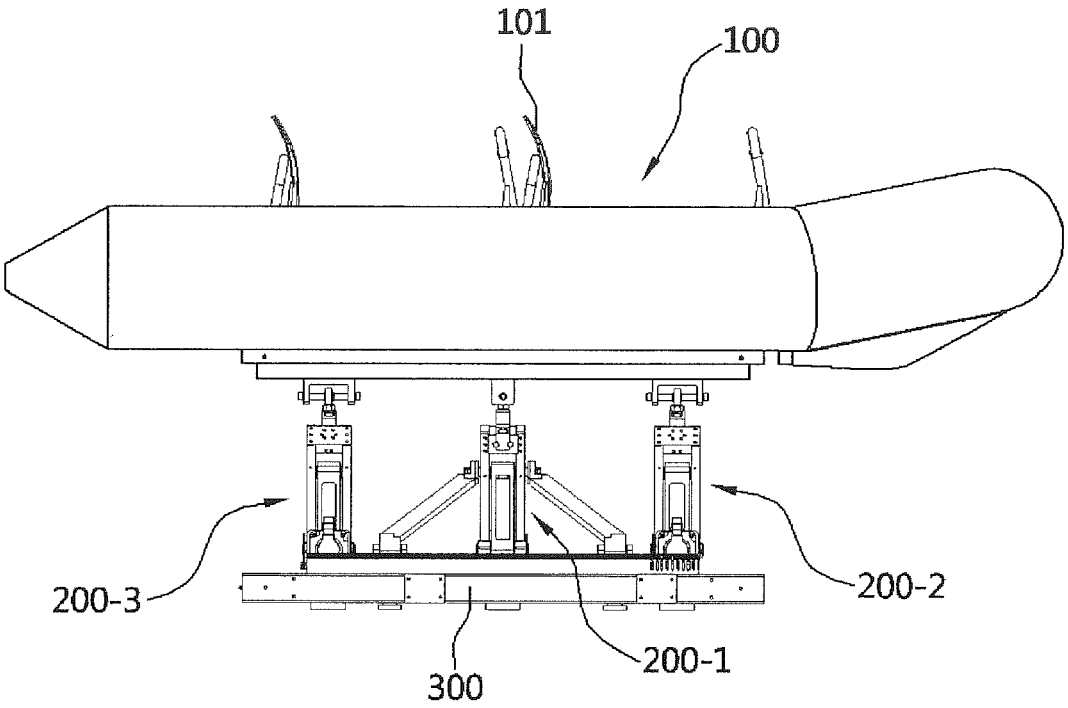
FIGS. 14A and 14B are views illustrating a state in which the first driving part, the second driving part, and the third driving part are extended in the motion simulator according to the present disclosure.
Figure 14B:
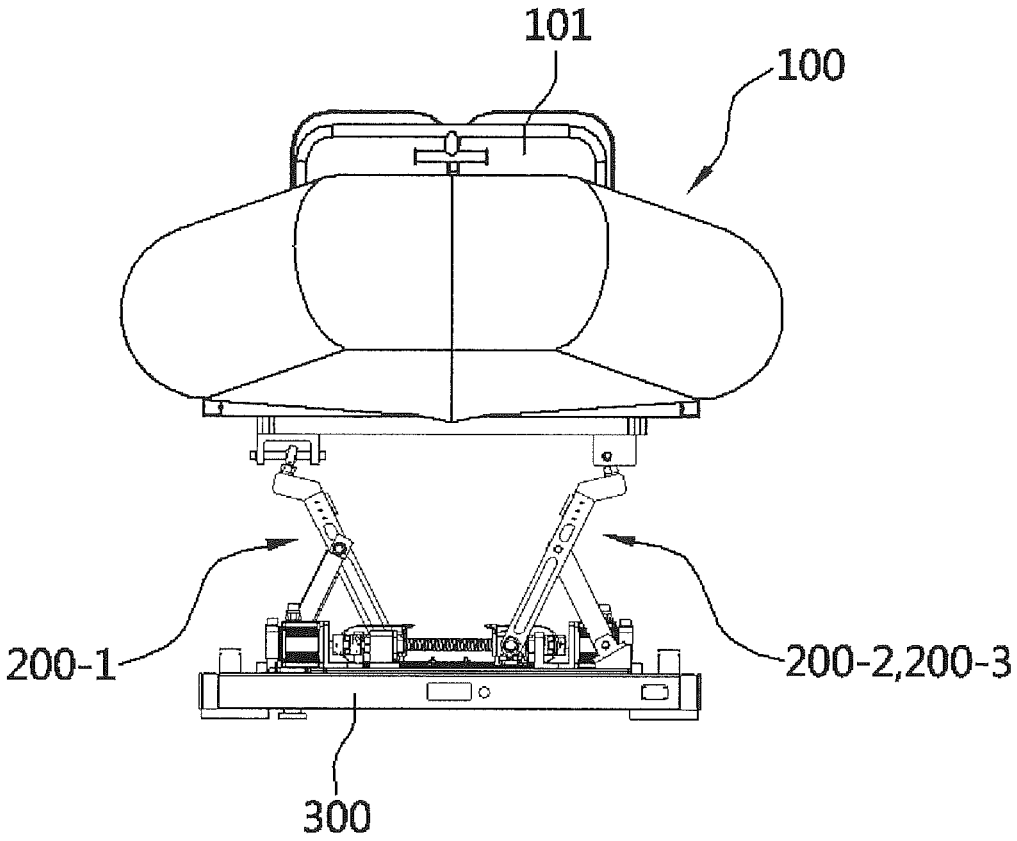

FIGS. 14A and 14B are views illustrating a state in which the first driving part, the second driving part, and the third driving part are extended in the motion simulator according to the present disclosure.

In this case, the first driving part 200-1 causes the first moving body 216-1 to move forward in the first direction so that the angle between the first movable link members 220-1 and 221-1 and the first fixed link member 230-1 is minimized, and the first link connection member 110-1 is moved to the uppermost side, the second driving part 200-2 causes the second moving body 216-2 to move forward in the second direction so that the angle between the second movable link members 220-2 and 221-2 and the second fixed link member 230-2 is minimized, and the second link connection member 110-2 is moved to the uppermost side, and the third driving part 200-3 causes the third moving body 216-3 to move forward in the second direction so that the angle between the third movable link members 220-3 and 221-3 and the third fixed link member 230-3 is minimized, and the third link connection member 110-3 is moved to the uppermost side. As described above, when the first driving part 200-1, the second driving part 200-2, and the third driving part 200-3 are driven to be in the state of being extended at the same time, the operations of FIGS. 10 to 12 are performed together, and the rolling, pitching, and yawing rotations are performed in combination.

Further, when the first driving part 200-1, the second driving part 200-2 and the third driving part 200-3 are driven according to a set order, various motion simulation movements in which the rolling, pitching, and yawing rotations are combined may be implemented.

According to the present disclosure, the stability of a motion simulator in operation can be improved by providing a plurality of driving parts configured to support a lower portion of a riding part and providing first and second support link members, which can prevent shaking, on a first driving part configured to support an intermediate portion of the lower portion of the riding part.

Further, a first fixed link member, a first support link member, and a second support link member can smoothly rotate around hinges on lower end portions thereof, respectively, by configuring the lower end portion of the first fixed link member, the lower end portion of the first support link member, and the lower end portion of the second support link member to be hinged at a position in a straight line.

Further, twisting of a link connection shaft and shaking of a first driving part due to the twisting can be prevented by configuring upper end portions of a first movable link member and a first fixed link member to be hinged to one link connection shaft, and an upper end portion of a first support link member and an upper end portion of a second support link member are to be hinged to the link connection shaft.

Further, a first support link member and a link connection shaft can stably rotate relative to each other by coupling a ball joint to one end portion of the link connection shaft.

Further, a first support link member and a ball joint can be prevented from being separated from a link connection shaft by coupling a lock nut to one end portion of the link connection shaft.

Further, first to third link connection members and a riding part can stably rotate relative to each other by coupling first to third supporting shafts to the first to third link connection members coupled to a lower portion of the riding part and providing first to third ball joints, which are relatively movable within ranges of lengths of the first to third supporting shafts, respectively, to the first to third supporting shafts.

Further, predetermined clearances can be formed in X-axis and Z-axis directions while supporting structures of first to third driving parts are firmly maintained during the operation of a motion simulator by configuring a first ball joint to be relatively movable in an X-axis direction within a range of the length of a first supporting shaft, and configuring a second ball joint and a third ball joint to be relatively movable within ranges of the lengths of a second supporting shaft and a third supporting shaft, respectively, in a Z-axis direction orthogonal to the X-axis direction, thereby improving the motion flexibility of the motion simulator.

Further, a first supporting member and a second supporting member can be installed in a direction parallel to a frame constituting a bottom supporting part by configuring a first support link connection member to be bent and extended in a direction toward the first supporting member at a lower end portion of a first support link member, and a second support link connection member to be bent and extended in the direction toward the second supporting member at a lower end portion of a second support link member, thereby simplifying a structure in which the first supporting member and the second supporting member are installed on the bottom supporting part.

Further, a motion simulator can be supported more stably by configuring a first driving part, a second driving part, and a third driving part to have the same structure, and thus each supports a lower portion of a riding part at positions forming a triangle.

As described above, although the present disclosure is described in detail with preferable examples, the present disclosure is not limited to the above-described embodiments, changes may be made within the scope of each of the claims, detailed descriptions, and the accompanying drawings, and the above may be included in the present disclosure.

What is claimed is:

1. A motion simulator comprising:

a riding part on which a passenger rides; and a plurality of driving parts configured to support a lower portion of the riding part, wherein the plurality of driving parts include a first driving part configured to support a central portion of the riding part, and a second driving part and a third driving part positioned on both sides of the first driving part with the first driving part therebetween and configured to support one side and the other side of the lower portion of the riding part, respectively, and the first driving part includes a first linear actuator configured to linearly reciprocate a first moving body, first movable link members each having a lower end portion hinged to the first moving body and an upper end portion hinged to a lower end portion of the riding part, a first fixed link member having an upper end portion hinged to the first movable link members and a lower end portion hinged at a position spaced apart from the first moving body, a first support link member having an upper end portion supporting one side of the first fixed link member and a lower end portion hinged at a position in a straight line with the lower end portion of the first fixed link member, and a second support link member having an upper end portion supporting the other side of the first fixed link member and a lower end portion hinged at a position in a straight line with the lower end portion of the first fixed link member and the lower end portion of the first support link member.

2. The motion simulator of claim 1, wherein the first movable link members and the upper end portion of the first fixed link member are hinged to one link connection shaft, and the upper end portion of the first support link member and the upper end portion of the second support link member are hinged to the link connection shaft.

3. The motion simulator of claim 2, wherein the first movable link members are provided in a pair on both sides of the first fixed link member, the first support link member is hinged to one side of the first movable link member positioned on one side thereof, and the second support link member is hinged to the other side of the first movable link member positioned on the other side thereof.

4. The motion simulator of claim 2, wherein a pair of ball joints are coupled to both end portions of the link connection shaft positioned outside the pair of first movable link members.

5. The motion simulator of claim 2, wherein the lower end portion of the first support link member is hinged to a first supporting member, which is fixed on a bottom supporting part, by a first supporting part hinge shaft, the lower end portion of the first support link member is integrally coupled to a first support link connection member bent and extended in a direction toward the first supporting member and is hinged by the first supporting part hinge shaft passing through and coupled to the first support link connection member, the first support link member is installed to be inclined at a predetermined angle in a direction of a link connection part, to which the first movable link member and the first support link member are hinged, with respect to the first support link connection member based on an X-axis direction, the lower end portion of the second support link member is hinged to a second supporting member, which is fixed on the bottom supporting part, by a second supporting part hinge shaft, the lower end portion of the second support link member is integrally coupled to a second support link connection member bent and extended in a direction toward the second supporting member and is hinged by the second supporting part hinge shaft passing through and coupled to the second support link connection member, and the second support link member is installed to be inclined at a predetermined angle in the direction of the link connection part, to which the first movable link member and the second support link member are hinged, with respect to the second support link connection member based on the X-axis direction.

6. The motion simulator of claim 1, wherein the upper end portion of the first support link member is hinged to one side of each of the first movable link members, and the upper end portion of the second support link member is hinged to the other side of each of the first movable link members.

7. The motion simulator of claim 1, wherein a first link connection member configured to connect the first driving part thereto is coupled to the lower portion of the riding part, both ends of a first supporting shaft inserted thereinto are coupled to both side surfaces of the first link connection member, and a first ball joint is coupled to the first supporting shaft so that the first link connection member and the riding part are rotatable relative to each other.

8. The motion simulator of claim 7, wherein the first ball joint is provided so as to be relatively movable within a range of a length of the first supporting shaft in a state of being coupled to the first supporting shaft.

9. The motion simulator of claim 7, wherein a first connection link member provided in a horizontal direction is integrally provided at the upper end portions of the first movable link members, and the first ball joint is coupled to an upper end portion of the first connection link member.

10. The motion simulator of claim 1, wherein the second driving part includes a second linear actuator configured to linearly reciprocate a second moving body, second movable link members each having a lower end portion hinged to the second moving body and an upper end portion hinged to the lower end portion of the riding part, and a second fixed link member having an upper end portion hinged to the second movable link members and a lower end portion hinged at a position spaced apart from the second moving body, and the third driving part includes a third linear actuator configured to linearly reciprocate a third moving body, third movable link members each having a lower end portion hinged to the third moving body and an upper end portion hinged to the lower end portion of the riding part, and a third fixed link member having an upper end portion hinged to the third movable link members and a lower end portion hinged at a position spaced apart from the third moving body.

11. The motion simulator of claim 10, wherein the first linear actuator of the first driving part linearly reciprocates the first moving body so that a first direction is a forward movement direction, the second linear actuator of the second driving part linearly reciprocates the second moving body so that a second direction opposite to the first direction is a forward movement direction, and the third linear actuator of the third driving part linearly reciprocates the third moving body so that the second direction is a forward movement direction.

12. The motion simulator of claim 10, wherein the first driving part, the second driving part, and the third driving part support the lower portion of the riding part at positions forming a triangle.

13. The motion simulator of claim 10, wherein the lower portion of the riding part is coupled to:

a first link connection member configured to connect the first driving part thereto, wherein both ends of a first supporting shaft inserted thereinto are coupled to both side surfaces of the first link connection member, the first supporting shaft is installed to have a length in an X-axis direction, a first ball joint is coupled to the first supporting shaft so that the first link connection member and the riding part are rotatable relative to each other, and the first ball joint is provided so as to be relatively movable in the X-axis direction within a range of the length of the first supporting shaft in a state of being coupled to the first supporting shaft;

a second link connection member configured to connect the second driving part thereto, wherein both ends of a second supporting shaft inserted thereinto are coupled to both side surfaces of the second link connection member, the second supporting shaft is installed to have a length in a Z-axis direction orthogonal to the first supporting shaft, a second ball joint is coupled to the second supporting shaft so that the second link connection member and the riding part are rotatable relative to each other, and the second ball joint is provided so as to be relatively movable in the Z-axis direction within a range of the length of the second supporting shaft in the state of being coupled to the second supporting shaft; and a third link connection member configured to connect the third driving part thereto, wherein both ends of a third supporting shaft inserted thereinto are coupled to both side surfaces of the third link connection member, the third supporting shaft is installed to have a length in the Z-axis direction, a third ball joint is coupled to the third supporting shaft so that the third link connection member and the riding part are rotatable relative to each other, and the third ball joint is provided so as to be relatively movable in the Z-axis direction within a range of the length of the third supporting shaft in the state of being coupled to the third supporting shaft.

* * * * *